US006123516A

United States Patent [19]

Burghard et al.

[11] Patent Number: 6,123,516

[45] Date of Patent: Sep. 26, 2000

[54] VACUUM PUMP

[75] Inventors: Hans Josef Burghard, Cologne; Wolfgang Giebmanns, Schmitten; Rudolf Bahnen, Roetgen, all of Germany

[73] Assignee: Leybold Vakuum GmbH, Cologne, Germany

[21] Appl. No.: 09/355,222

[22] PCT Filed: Jan. 20, 1998

[86] PCT No.: PCT/EP98/00288

§ 371 Date: Jul. 26, 1999

§ 102(e) Date: Jul. 26, 1999

[87] PCT Pub. No.: WO98/39570

PCT Pub. Date: Sep. 11, 1998

[30] Foreign Application Priority Data

Mar. 6, 1997 [DE] Germany ..... 197 09 206

[51] Int. Cl.[7] ..... F04B 3/00

[52] U.S. Cl. ..... 417/250; 417/267; 418/8

[58] Field of Search ..... 417/441, 266, 417/267, 521, 250; 418/13, 8, 15

[56] References Cited

U.S. PATENT DOCUMENTS

| | | | |
|---|---|---|---|
| 4,725,204 | 2/1988 | Powell | 417/205 |
| 5,092,740 | 3/1992 | Yamamura | 417/201 |
| 5,356,275 | 10/1994 | Brenner et al. | 418/9 |
| 5,482,443 | 1/1996 | Bez | 417/266 |
| 5,547,347 | 8/1996 | Sethna et al. | 417/250 |
| 5,573,387 | 11/1996 | Holbrook | 418/13 |

FOREIGN PATENT DOCUMENTS

| | | |
|---|---|---|
| 63105294 | 10/1988 | European Pat. Off. . |
| 5231369 | 7/1993 | European Pat. Off. . |
| 597730 | 5/1994 | European Pat. Off. . |
| 731274 | 9/1996 | European Pat. Off. . |
| 3520634 | 12/1986 | Germany . |
| 37 10782 | 10/1988 | Germany . |
| 92 15786 | 9/1992 | WIPO . |

OTHER PUBLICATIONS

Patent Abstracts of Japan, vol. 012, No. 346 (M–742)Sep. 16, 1988 & JP 63 105294A (Hitachi Ltd; others: 01), May 10, 1988.

Wutz et al., "Theorie und Praxis der Vakuumtchnik," Verlag Friedr., Vieweg & Sohn, Braunschweig/Wiesbaden, 3. überarb. Aufl., 1986, S. 134–139 No Translation.

Füssel, "Trockenlaudfende Vakuumpumpen in der chemischen Industrie", In: Vakuum in der Praxis, 1994, Nr. 2, S.85–88; No Translation.

*Primary Examiner*—Charles G. Freay
*Assistant Examiner*—Robert Z. Evora
*Attorney, Agent, or Firm*—Wall Marjama Bilinski & Burr

[57] ABSTRACT

A vacuum pump, comprising at least one pump chamber (7, 8, 23 to 26) and at least one chamber (3, 5, 27) adjoining the pump chamber. The vacuum pump is fitted with a gas ballast device to avoid damage being caused in the adjoining chambers by the gases being pumped, the ballast gas being delivered via the chamber adjoining the pump chamber.

9 Claims, 1 Drawing Sheet

VACUUM PUMP

CROSS-REFERENCES TO RELATED APPLICATIONS

This application is a 371 of PCT/EP98/00288 filed on Jan. 20, 1998.

BACKGROUND OF THE INVENTION

The present invention relates to a vacuum pump, comprising at least one pump chamber and at least one chamber for a motor, drive, gear, crankshaft or the like, adjoining said pump chamber.

In many branches of industry, vacuum pumps of the kind affected here need to pump etching and/or toxic gases. These gases may enter into chambers adjoining the pump chambers, said chambers being generally separated by seals (shaft seals, labyrinth boxes etc.) from the pump chambers. Etching gases give rise to corrosion or abrasions in these chambers, resulting in premature wear of the bearings or damage to other components located therein. Moreover, etching or toxic gases may pass through the chambers adjoining the pump chamber into the atmosphere. In the semiconductor industry, the demand for dry vacuum pumps, i.e. vacuum pumps which are free of oil at least with respect to their pump chamber, is ever increasing. The reason for this is, that the processes which are performed in vacuum chambers to which the vacuum pumps are connected, need to be protected against interfering hydrocarbons. The gases forming or employed in the semiconductor industry pumped by the vacuum pump often have the property of forming solids while they are being compressed to atmospheric pressure. Also deposits of this kind may cause harm in the chambers adjoining the pump chamber.

SUMMARY OF THE INVENTION

It is the task of the present invention to design a vacuum pump of the aforementioned kind so that the risk of damage in the chambers adjoining the pump chamber as well as escaping of etching or toxic gases from the vacuum pump is mostly reduced.

This task is solved through the present invention by equipping the vacuum pump with a gas ballast device and by feeding the ballast gas through the chambers adjoining the pump chamber. A vacuum pump designed according to the present invention has an outer gas ballast or purge gas inlet, and a gas inlet located directly at the casing of the pump chamber. Located between outer gas inlet and gas inlet are one or several chambers in need of being purged adjoining the pump chamber. In a pump designed as detailed, the gas entering through the gas ballast inlet has the effect of purging the chamber or chambers adjoining the pump chamber. If etching or toxic gases enter in to the chamber adjoining the pump chamber through seals which are not, or no longer completely fulfilling their sealing task, then these gases are pumped back together with the ballast or purge gas into the pump before being able to cause damage or escaping into the atmosphere. A further advantage of the present invention is, that the design engineer has more options at his disposal regarding the choice for the location of the inlet for the gas ballast or purge gas. Finally, the gas inlet at the casing of the pump chamber may be held open all the time, so that a low pressure forms in the chamber adjoining the pump chamber. The risk of toxic or etching gases escaping through leaks in the outer casing is thus further reduced.

BRIEF DESCRIPTION OF THE DRAWINGS

Further advantages and details of the present invention shall be explained by reference to the design examples depicted schematically in drawing FIGS. 1 and 2. Depicted in drawing

DESCRIPTION OF THE INVENTION

Figure 1:
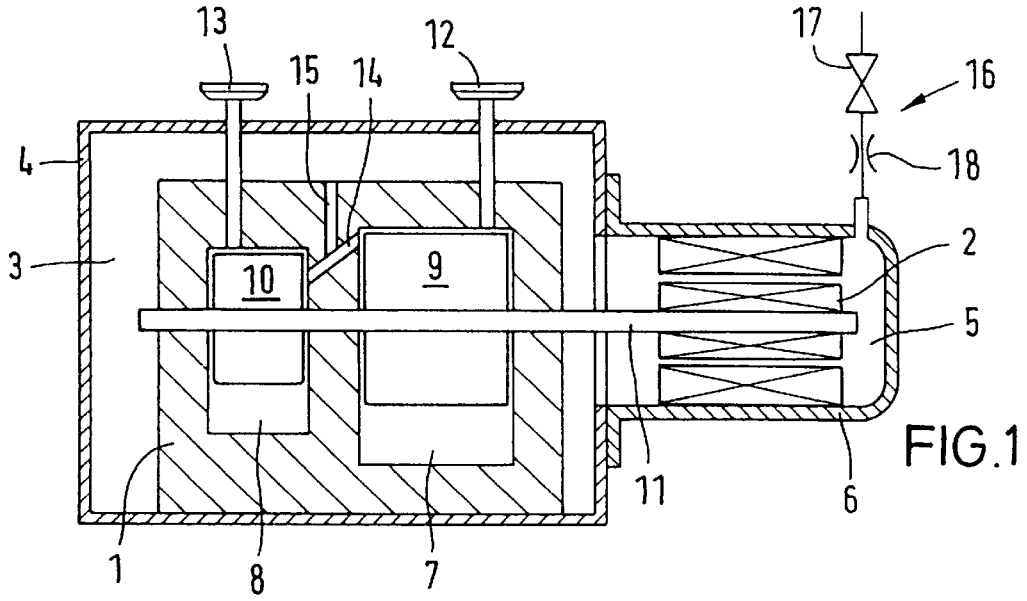
FIG. 1 is a two-stage rotary vane vacuum pump and drawing FIG. 2 a four-stage piston vacuum pump.

The rotary vane vacuum pump depicted in drawing FIG. 1 comprises pump chamber casing 1 and drive motor 2. The pump chamber casing 1 is located within pump chamber 3 formed by outer casing 4, the motor in motor chamber 5 formed by motor casing 6 which is flanged to the outer pump casing 4. Located in pump chamber casing 1 are the pump chambers 7 and 8 with their rotors 9 and 10. The rotors 9 and 10 are fitted to motor shaft 11 which is supported by multiple bearings in pump chamber casing 2 and which is sealed. The larger stage 7, 9 of the pump is the inlet stage and it is linked to inlet 12. The outlet 13 is linked to outlet stage 8, 10. Inlet stage 7, 9 and outlet stage 8, 10 are linked to each other through bore 14. Bore 15 opens into this bore 14. Bore 15 is linked to pump chamber 3 and this bore is designated in the following as the gas ballast or purge gas inlet close by to the pump chamber. The gas ballast or purge gas inlet located outside the pump is designated as 16. It comprises valve 17 and constriction 18.

In the design example presented in drawing FIG. 1, the gas inlet 16 is located in an area at the motor casing 6, remote of pump casing 4. With valve 17 open, i.e. during gas ballast or purge gas operation, the gas flows through motor chamber 5 and through pump chamber 3 to the inlet of bore 15, which is the gas inlet located directly at the pump chamber casing. Gases escaping into the pump or the motor chamber through leaking shaft seals are purged back into the outlet stage 8, 10. If required, baffles and/or several inlet ports 16 may be present so as to ensure full purging of the chambers adjoining the pump chambers 7, 8. Moreover, an inert gas reservoir vessel may be connected to inlet port 16, if there is a requirement for purging with an inert gas like $N_2$, for example, or if a gas ballast is to be produced.

The ballast gas or purge gas inlet 15 close by to the pump chamber is at all times open in the direction of pump chamber 3. If valve 17 is closed, a vacuum forms in pump chamber 3 and the motor chamber 5. Therefore gases entering through leaks in casings 4, 6 into pump chamber 3 and motor chamber 5 can not escape to the outside. When valve 17 is open, constriction 18 ensures that a low pressure is maintained in the casings 4 and 6.

Figure 2:
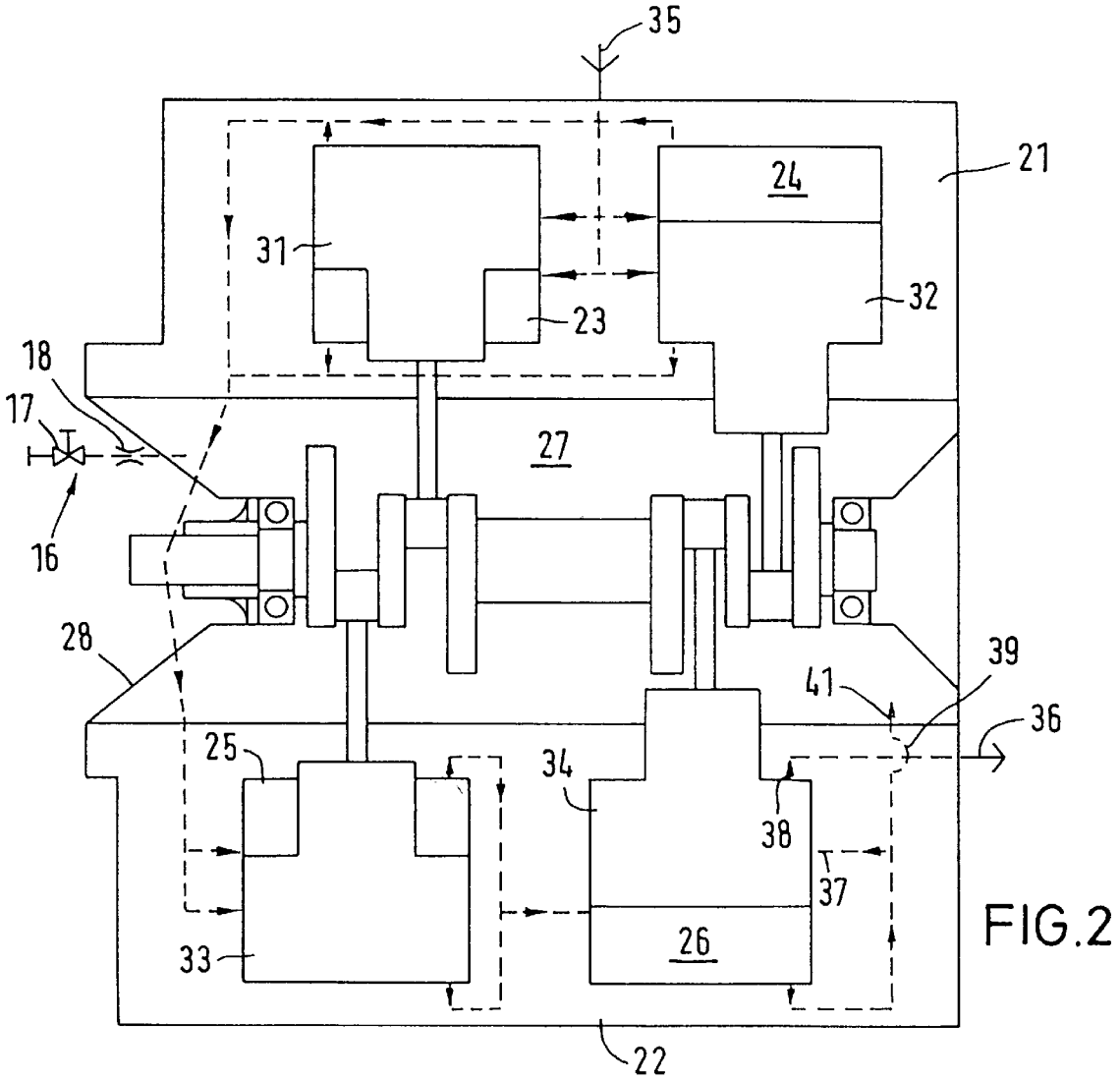

Depicted in drawing FIG. 2 is a four-stage dry compressing piston vacuum pump with its pump chamber casing sections 21 and 22 accommodating cylindrically shaped pump chambers 23 to 26. Located between casing sections 21, 22 is the crankshaft chamber 27, the casing of which is designated as 28. The pistons 31 to 34 are each graded and form eight pump chambers which are in part connected in parallel so that the pump presented has four pumping stages. Its inlet is designated as 35, its outlet as 36. In the older German patent application 196 34 519.7 a vacuum pump of this kind is detailed. The last annular pump chamber forms the last stage of the vacuum pump presented. Its inlet is designated as 37, its outlet as 38.

The inlet 37 of the pump's last stage is linked via line 39 to the crankshaft chamber 27. Its opening forms the gas inlet 41 close by to the pump chamber. It is located in the vicinity of one face side of crankshaft chamber 28. Located in the area of the opposing side of crankshaft casing 28 is the gas ballast or purge gas inlet 16 with valve 17 and constriction 18. Through the means already described in connection with drawing FIG. 1, gas flowing in through gas inlet 16 may purge the crankshaft chamber 27 and maintain a low pressure therein.

What is claimed is:

1. A vacuum pump comprising:

an outer casing;

at least one pumping chamber disposed in an interior pumping chamber casing, said at least one pumping chamber having a proximate gas inlet disposed in said interior pumping chamber casing;

at least one adjacent pump chamber adjoining said pumping chamber within said outer casing; and a gas ballast means for admitting ballast gas into said at least one pumping chamber through said at least one adjacent pump chamber; said gas ballast means including an inlet including a valve and a constriction disposed in said outer casing remote from the proximate gas inlet of said interior pumping chamber casing for selectively purging said at least one adjacent pump chamber when said valve is closed and in which said constriction creates a low pressure within said at least one adjacent pump chamber when said valve is opened when said pump requires gas ballast such that gas from said at least one pumping chamber is prevented from being released through said outer casing to the atmosphere.

2. A vacuum pump according to claim 1, that further includes a plurality of gas inlets at several locations in the adjacent pump chamber.

3. A vacuum pump according to claim 1, wherein the inlet of said outer casing is linked to an inert gas reservoir vessel.

4. A vacuum pump according to claim 1, wherein said pump is a rotary vane vacuum pump.

5. A vacuum pump according to claim 4, wherein said pump is a two stage rotary vane vacuum pump including a pair of pumping chambers constituting inlet and outlet stages disposed in said pumping chamber casing that further includes a bore that is connected to a linking bore passing between the inlet and outlet stages of said pump so that said linking bore communicates with the adjacent pump chamber.

6. A vacuum pump according to claim 5, wherein an adjacent pump chamber includes an adjacent motor chamber and in which the gas inlet of said outer casing is provided in the motor chamber.

7. A vacuum pump according to claim 1, wherein the pump is a multi-stage piston vacuum pump.

8. A vacuum pump according to claim 7, wherein the proximate gas inlet of the last pumping stage of said multi-stage piston vacuum pump is linked to an crankshaft chamber in which said crankshaft chamber is the adjacent pump chamber.

9. A vacuum pump according to claim 8, wherein said crankshaft chamber includes an inlet line extending to the last pumping stage and the gas inlet of the outer casing are arranged at opposing face sides of the crankshaft chamber.

* * * * *

UNITED STATES PATENT AND TRADEMARK OFFICE
Certificate

Patent No. 6,123,516 Patented: September 26, 2000

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Hans Josef Burghard, Cologne, Germany; Wolfgang Giebmanns, Schmitten, Germany; Rudolf Bahnen, Roetgen, Germany; and Jurgen Meyer, Pulheim, Germany.

Signed and Sealed this Thirtieth Day of September 2003.

JUSTINE YU
*Supervisory Patent Examiner*
Art Unit 3746